US011400748B2

(12) United States Patent
Rack et al.

(10) Patent No.: US 11,400,748 B2
(45) Date of Patent: Aug. 2, 2022

(54) SECURITY ELEMENT COMPRISING A LENTICULAR IMAGE

(71) Applicant: GIESECKE+DEVRIENT CURRENCY TECHNOLOGY GMBH, Munich (DE)

(72) Inventors: Veronika Rack, Bayrischzell (DE); André Gregarek, Munich (DE); Annett Bahr, Rimsting (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 17/261,270

(22) PCT Filed: Jul. 9, 2019

(86) PCT No.: PCT/EP2019/000211

§ 371 (c)(1),
(2) Date: Jan. 19, 2021

(87) PCT Pub. No.: WO2020/015848

PCT Pub. Date: Jan. 23, 2020

(65) Prior Publication Data

US 2021/0276359 A1 Sep. 9, 2021

(30) Foreign Application Priority Data

Jul. 19, 2018 (DE) ..... 10 2018 005 697.0

(51) Int. Cl.
*B42D 25/324* (2014.01)
*B42D 25/351* (2014.01)
(Continued)

(52) U.S. Cl.
CPC ..... *B42D 25/378* (2014.10); *B42D 25/324* (2014.10); *B42D 25/351* (2014.10);
(Continued)

(58) Field of Classification Search
CPC ..... B42D 25/324
See application file for complete search history.

(56) References Cited

U.S. PATENT DOCUMENTS 6,183,018 B1 * 2/2001 Braun ..... B42D 25/43 283/109
8,409,693 B2 4/2013 Endres et al.
(Continued)

FOREIGN PATENT DOCUMENTS

AU 2017101215 A4 10/2017
CA 3040447 A1 * 4/2018 ..... B42D 25/378
(Continued)

OTHER PUBLICATIONS

EP-2988154-A2 English Translation (Year: 2016).*
(Continued)

*Primary Examiner* — Kyle R Grabowski
(74) *Attorney, Agent, or Firm* — Workman Nydegger

(57) ABSTRACT

A security element for securing security papers, value documents and other data carriers, includes a lens grid image with a lens grid of a plurality of micro lenses and a radiation-sensitive motif layer arranged at a distance from the lens grid. The radiation-sensitive motif layer includes, in one motif region, a multiplicity of transparency regions produced by the action of radiation. The radiation-sensitive motif layer has, at least in the motif region, a color partial layer and a contrast partial layer. The color partial layer includes chromophore effect pigments which appear to be colored against the background of the contrast partial layer and which appear to be transparent without a contrast layer.

17 Claims, 6 Drawing Sheets

(51) Int. Cl.

| | |
|---|---|
| ***B42D 25/364*** | (2014.01) |
| ***B42D 25/378*** | (2014.01) |
| ***B42D 25/435*** | (2014.01) |
| *B42D 25/23* | (2014.01) |
| *B42D 25/29* | (2014.01) |
| *B42D 25/355* | (2014.01) |

(52) U.S. Cl.
CPC ..... *B42D 25/364* (2014.10); *B42D 25/435* (2014.10); *B42D 25/23* (2014.10); *B42D 25/29* (2014.10); *B42D 25/355* (2014.10)

(56) References Cited

U.S. PATENT DOCUMENTS

| | | | | |
|---|---|---|---|---|
| 8,875,628 | B2 * | 11/2014 | Depta | B41J 2/471 101/170 |
| 2005/0109850 | A1 * | 5/2005 | Jones | B42D 25/42 235/487 |
| 2007/0087173 | A1 | 4/2007 | Endres et al. | |
| 2010/0290039 | A1 | 11/2010 | Endres et al. | |
| 2012/0091703 | A1 * | 4/2012 | Maguire | B42D 25/43 283/85 |
| 2012/0137910 | A9 * | 6/2012 | Marchant | B42D 25/29 101/483 |
| 2012/0193905 | A1 * | 8/2012 | Schilling | B42D 25/324 283/74 |
| 2013/0167355 | A1 | 7/2013 | Lutz et al. | |
| 2013/0193679 | A1 * | 8/2013 | Fuhse | B42D 25/41 283/85 |
| 2018/0361777 | A1 * | 12/2018 | Fuhse | B42D 25/373 |
| 2019/0322117 | A1 * | 10/2019 | Lister | B42D 25/415 |

FOREIGN PATENT DOCUMENTS

| | | | | | |
|---|---|---|---|---|---|
| DE | 102009006301 | A1 * | 7/2010 | | B42D 25/324 |
| DE | 102010025278 | A1 | 12/2011 | | |
| DE | 102015015991 | A1 | 6/2017 | | |
| EP | 1983473 | A1 | 10/2008 | | |
| EP | 2988154 | A2 * | 2/2016 | | B42D 25/29 |
| EP | 3015279 | A1 * | 5/2016 | | B42D 25/435 |
| EP | 3015279 | A1 | 5/2016 | | |
| GB | 2551555 | A * | 12/2017 | | B42D 25/24 |
| WO | 2010115235 | A1 | 10/2010 | | |
| WO | WO-2013156149 | A1 * | 10/2013 | | B42D 25/29 |
| WO | 2014127403 | A1 | 8/2014 | | |
| WO | 2017097430 | A1 | 6/2017 | | |
| WO | WO-2017097430 | A1 * | 6/2017 | | B42D 25/29 |

OTHER PUBLICATIONS

Search Report from corresponding DE Application No. 102018005697.0, dated Apr. 30, 2019.

International Search Report and Written Opinion for PCT Application No. PCT/EP2019/000211, dated Oct. 17, 2019.

* cited by examiner

SECURITY ELEMENT COMPRISING A LENTICULAR IMAGE

BACKGROUND

The invention relates to a security element for securing security papers, value documents and other data carriers, with a lens grid image that includes a lens grid of a plurality of micro lenses and a radiation-sensitive motif layer arranged at a distance from the lens grid, wherein the radiation-sensitive motif layer in a motive region includes a multiplicity of transparency regions produced by the action of radiation.

Data carriers, such as value documents or identification documents, but also other objects of value, such as branded articles for example, are often supplied for securing purposes with security elements which permit a verification of the authenticity of the data carrier and which at the same time serve as protection from unauthorized reproduction.

A special role in authentication assurance is played by security elements with viewing angle-dependent effects because these cannot be reproduced even with the most modern copying devices. The security elements are equipped here with optically variable elements which convey a different pictorial impression to the viewer from different viewing angles, showing for example a different color impression or brightness impression and/or a different graphic motif depending on the viewing angle.

In this context, it is known to supply the data carriers with laser-engraved tilt images for securing purposes. Two or more different markings, for example a serial number and an expiry date, are laser-engraved into the data carrier at different angles by an arrangement of cylindrical lenses. The laser radiation produces a local blackening of the data carrier, which makes the engraved markings visually visible. Upon viewing, depending on the viewing angle, only the marking engraved from this direction is visible, so that by tilting the data carrier perpendicularly to the axis of the cylinder lenses, an optically variable tilt effect is created.

In the case of tilt images, in order to increase the protection against forgery, it is further desirable if the representations visible from different directions have different colors.

Several methods are known for the manufacture of tilt images, but all of them each have certain disadvantages. In principle, the known methods can be distinguished according to whether the micro images present in a motif layer are produced with or without the aid of the lens grid of the tilt image.

The micro images can be printed or embossed, for example, without the aid of the lens grid. These manufacturing variants are usually very cost-effective, but especially with the very thin layer structures that are important in security printing, it is usually not possible to arrange the micro images in such precise register with the lens grid that the different representations always appear at the same angle, i.e. for example, when viewing several banknotes with the same tilt image next to one another, all banknotes show the same representation from a certain angle.

Other manufacturing methods utilize the lens grid to structure the micro images. In particular, laser engraving methods are used here in which an image is inscribed in a motif layer by means of a laser through the lenses of the lens grid. For this purpose, the motif layer either is subjected to laser radiation through a mask or a laser beam is scanned over the motif layer in order to inscribe a desired motif. With both method variants, the motif is inscribed below the lenses in the focus and is therefore always in perfect register with the lenses. In addition, it is ensured that the inscribed motif is later visible from precisely the direction from which it was exposed with the laser beam. However, it is disadvantageous that the laser engraving methods are often difficult to implement on an industrial scale. For example, the laser-cutting of millimeter-sized motifs using a mask or scanner in foil production with the foil widths and process speeds customary for security applications represents a major and costly technical challenge. This applies in particular when a respectively different representation has to be lasered into the motif layer in order to implement two or several different, direction-dependent, visible motifs from two or more different directions.

SUMMARY

Proceeding from this, the invention is based on the object of specifying a security element of the type mentioned at the outset, which has a visually attractive appearance and is easy to manufacture.

According to the invention, it is provided in a generic security element that the radiation-sensitive motif layer has, at least in the motif region, a color partial layer and a contrast partial layer, wherein the color partial layer comprises chromophore effect pigments which appear to be colored against the background of the contrast partial layer and which appear to be transparent without a contrast layer.

The contrast partial layer is preferably formed by a chromatic or dark, in particular black, printing layer. All colors that are not white, black or gray are called chromatic colors. For a high contrast, chromatic colors with a high saturation, for example a saturated red, blue or green, are preferred.

The color partial layer advantageously includes interference pigments, pearl luster pigments and/or liquid crystal pigments as chromophore effect pigments. The color partial layer can in particular be an Iriodin® printing layer with mica-based pearl luster pigments. Such pearl luster pigments produce gloss and color effects, the color spectrum of which ranges from silver-white to red and bronze-colored earth tones to gold luster. According to current understanding, the color effects are created by an interplay of transparency, light refraction and multiple reflections on the partial layers of the pigments. The pearl luster pigments are usually composed of thin mica flakes that are enveloped by a thin metal oxide layer. Other interference pigments can also include other carrier materials and several different coatings.

The contrast partial layer lies behind the color partial layer when viewed from the lens grid and therefore forms a background layer for the color partial layer from the viewing direction. While the radiation-sensitive motif layer can in principle also have three or more partial layers, an advantageous configuration provides that the radiation-sensitive motif layer is composed only of the two partial layers mentioned, namely the color partial layer and the contrast partial layer.

The color partial layer and/or the contrast partial layer are advantageously applied with an ink layer thickness between 0.5 and 10 $g/m^2$, in particular between 1 and 2 $g/m^2$.

In a preferred embodiment, the contrast partial layer and/or the color partial layer are configured in the form of patterns, characters, or a code.

At least the contrast partial layer of the motif layer is preferably removed in the transparency regions. The color partial layer can advantageously also be removed in the transparency regions, or it can also be advantageously preserved in the transparency regions. Both variants each have certain advantages, which are described in more detail below in connection with the embodiment examples.

In a preferred, more specific embodiment, it is further provided that the lens grid image shows at least two different appearances from different viewing directions, wherein

- the transparency regions each are arranged in precise register with the micro lenses of the lens grid, and
- the radiation-sensitive motif layer is opaque outside the transparency regions produced by the action of radiation and is structured in the motif region in the form of a first motif, so that the first motif is visible as the first appearance when viewing the security element from a first viewing direction through the lens grid.

Even if the transparency regions are always arranged in precise register with the micro lenses, this does not, conversely, also mean that a transparency region must be assigned to each micro lens. Rather, it is provided in an advantageous embodiment that there is a partial region in which there are no transparency regions in the motif layer. The partial region without transparency regions is advantageously configured in the form of a further motif which lies completely within the motif formed by the motif layer itself. In this manner, precisely registered tilt effects can be produced, as described in more detail below.

In a preferred embodiment, the radiation-sensitive motif layer is laser-sensitive and is in particular ablated by laser radiation.

The refractive effect of the micro lenses of the lens grid defines a focal plane, wherein the radiation-sensitive motif layer advantageously is arranged substantially in this focal plane. The motif layer does not have to lie exactly in the focal plane but can in some configurations be up to half a focal length above or below the focal plane. Such a defocused arrangement of the motif layer can be particularly advantageous when a particularly small thickness of the security element is to be achieved or a particularly large region below the respective micro lenses is to be made transparent. By arranging the motif layer outside the focal plane, the viewing angles from which the appearances are visible can also be influenced and, in particular, increased. A large viewing angle range represents a particularly desirable product property of the security elements described.

In an advantageous embodiment, it is provided that the lens grid has or represents a one-dimensional arrangement of micro lenses, in particular cylinder lenses. It can also advantageously be provided that the lens grid has or represents a two-dimensional arrangement of micro lenses, in particular of spherical or aspherical lenses.

In the context of this description, such lenses are referred to as micro lenses the size of which is below the resolution limit of the naked eye in at least one lateral direction. The micro lenses can be configured to be cylindrical in particular, but the use of spherical or aspherical lenses is also conceivable. The latter preferably have a diameter between 5 μm and 300 μm, in particular between 10 μm and 50 μm, particularly preferably between 15 μm and 20 μm. Micro cylinder lenses preferably have a width between 5 μm and 300 μm, particularly between 10 μm and 50 μm, particularly preferably between 15 μm and 20 μm. The length of the micro cylinder lenses is arbitrary; for example, when used in security threads or transfer elements, it can also correspond to the total width of the thread or transfer element and amount to several millimeters or several centimeters.

In an advantageous embodiment, on the side of the radiation-sensitive motif layer facing away from the lens grid, a second motif layer is arranged, which is structured in the form of a second motif, so that the second motif is visible as a second appearance when viewing the security element from a second viewing direction through the lens grid and the transparency regions of the radiation-sensitive motif layer.

The second motif layer is advantageously formed by a chromatic or dark, in particular black, printing layer, wherein it is presently preferred that the second motif layer has the same color or the same color tone as the contrast partial layer.

Advantageous visual effects can be achieved in particular when the second motif layer, apart from the transparency regions produced by the action of radiation, lies completely within the area of the contrast partial layer.

According to a further, also advantageous embodiment, one or several transparent layers are arranged on the side of the radiation-sensitive motif layer facing away from the lens grid, so that an underground lying below the security element is visible as a second appearance when viewing the security element from a second viewing direction through the lens grid and the transparency regions of the radiation-sensitive motif layer.

The invention also comprises a data carrier, in particular a value document, a security paper, an identification card, a branded article or the like, with a security element of the type described.

Such a data carrier can in particular include a security element without a second motif layer, in which one or several transparent layers are arranged in the manner described above on the side of the radiation-sensitive motif layer facing away from the lens grid. It is further provided that the data carrier is supplied in a partial region with a second motif layer which is structured in the form of a second motif. The security element is then arranged with the lens grid and the transparency regions above the second motif layer so that the second motif is visible as a second appearance when viewing the security element from a second viewing direction through the lens grid and the transparency regions of the radiation-sensitive motif layer. In this manner, data carriers with tilt images can be produced in a simple manner, which show a general, generic motif (first motif) from a first viewing direction and an individualized motif (second motif) from a second viewing direction, as explained in more detail below.

The invention also includes a method for manufacturing a security element with a lens grid image, in which

- a carrier substrate is made available and supplied with a lens grid of a plurality of micro lenses and a radiation-sensitive motif layer arranged at a distance from the lens grid, and
- in the radiation-sensitive motif layer a multiplicity of transparency regions is produced by the action of radiation through the lens grid.

According to the invention, it is further provided that the radiation-sensitive motif layer is formed, at least in the motif region, with a color partial layer and a contrast partial layer, and the color partial layer comprises chromophore effect pigments that appear to be colored against the background of the contrast partial layer and appear to be transparent without a contrast layer.

In a preferred, more concrete method implementation, the lens grid image shows at least two different appearances from different viewing directions, wherein in the method

- the transparency regions in the radiation-sensitive motif layer are produced in precise register with the micro lenses of the lens grid, and
- the radiation-sensitive motif layer outside the transparency regions produced by the action of radiation are opaque and configured to be structured in the form of a first motif, so that the first motif is visible as the first appearance when viewing the security element from a first viewing direction through the lens grid.

In an advantageous method implementation, the radiation-sensitive motive layer is subjected to laser radiation through the lens grid in order to produce the transparency regions. The radiation-sensitive motif layer is advantageously ablated by the laser radiation.

The laser sources employed are advantageously IR or NIR lasers (NIR: wavelength 0.78-3 μm), particularly lasers in the IR-A range (wavelength 0.78-1.4 μm), for example at a wavelength of around 1064 nm. In the case of an NIR laser, for example with the wavelength mentioned, the following parameters are suitable for ablation:

Frequency: 10-100 kHz, preferably 10-20 kHz

Feed: 10-2500 mm/s, preferably 100-300 mm/s

Power: 0.1-100%, preferably 0.1-3.5% with a 10 W laser.

A security element according to the invention can also include more than two representations which are visible from more than two different viewing directions.

DESCRIPTION OF THE DRAWINGS

Further embodiment examples as well as advantages of the invention will be explained hereinafter with reference to the figures, in whose representation a rendition that is true to scale and to proportion has been dispensed with in order to increase the clearness.

There are shown.

DETAILED DESCRIPTION OF VARIOUS EMBODIMENTS

Figure 1:
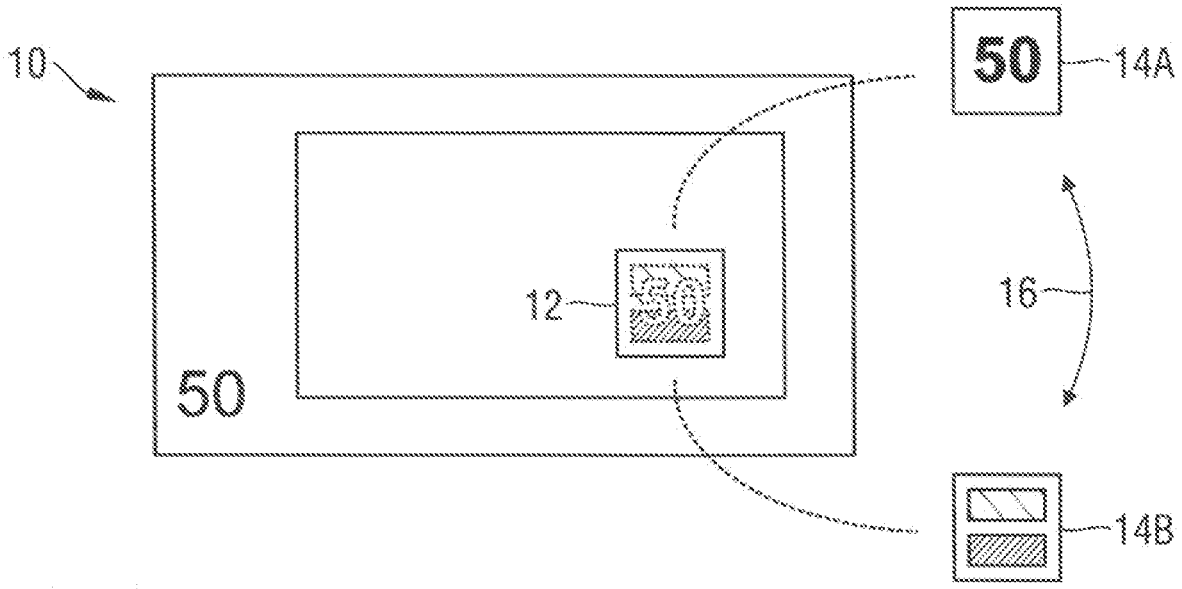
FIG. 1 in a schematic representation a banknote with a security element according to the invention including a tilt image with two different appearances, FIG. 2 schematically the layer structure of the security element of FIG. 1 in cross section, FIG. 3 a plan view of the security element of FIG. 2 without the lens grid and thus without the focusing effect of the micro lenses, FIGS. 4 to 7 the manufacture of the security element of FIGS. 2 and 3, wherein (a) shows a respective intermediate step in the manufacture of the security element and (b) shows the appearance of the respective intermediate product in plan view without the lens grid and thus without the focusing effect of the micro lenses, FIG. 8 schematically a security element according to the invention in which the second motif layer has been dispensed with, FIG. 9 a security element with a precisely registered tilt effect according to a further embodiment example of the invention in cross section, FIG. 10, including FIGS. 10(*a*) and 10(*b*), the appearance of the security element of FIG. 9 from two viewing directions, FIG. 11 a security element with a precisely registered tilt effect according to a further embodiment example of the invention in cross section, and FIG. 12, including FIGS. 12(*a*) and 12(*b*), the appearance of the security element of FIG. 11 from two viewing directions.

The invention will now be explained by the example of security elements for banknotes. FIG. 1 shows a schematic representation of a banknote 10 which is supplied with a security element 12 according to the invention in the form of a transfer element adhesively bonded thereto. In the embodiment example, the security element 12 represents a tilt image which, depending on the viewing direction, shows one of two different appearances 14A, 14B.

However, the invention is not limited to the transfer elements for banknotes shown for illustration purposes, but can also be used, for example, for security threads, broad security strips or covering foils that are arranged above an opaque region, a window region or a continuous opening of a data carrier.

Returning to the representation of FIG. 1, the two appearances in the embodiment example are formed by a two-color representation 14A of the value number "50" and a representation 14B of two, colored rectangles, but it will be appreciated that the appearances in practice represent typically more complex motifs, such as geometric patterns, portraits, codes, numbering, architectural, technical or natural motifs. Upon tilting 16 the banknote 10 or a corresponding change in the viewing direction, the appearance of the security element 12 changes back and forth between the two appearances 14A, 14B.

While lens grid images with tilt images are known as such, the present invention makes available a specially configured lens grid image in which the represented motifs are introduced into the motif layer of the lens grid image in a particularly simple and yet highly accurate manner.

Figure 2:
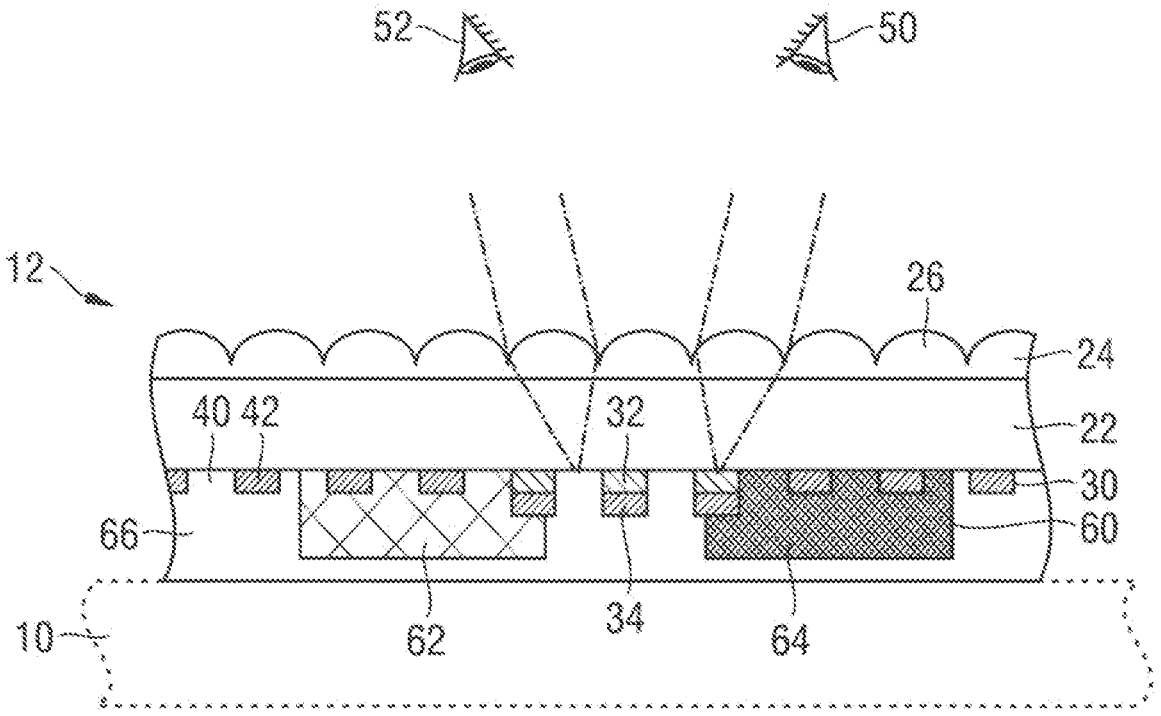
Figure 3:
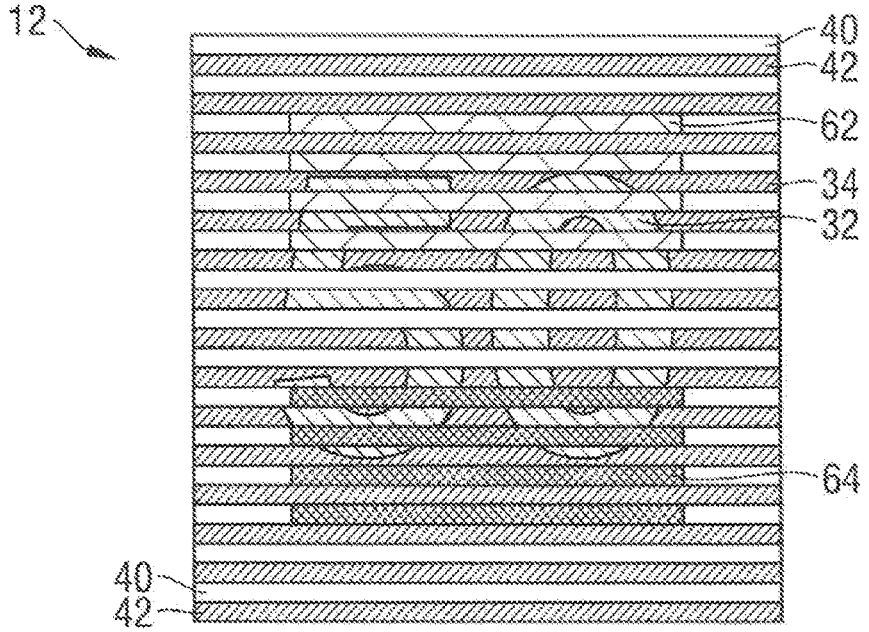

FIG. 2 schematically shows the layer structure of the security element 12 according to the invention in cross-section, wherein only the parts of the layer structure required for the explanation of the functional principle are represented. FIG. 3 shows a plan view of the security element 12 without the lens grid and thus without the focusing effect of the micro lenses.

FIGS. 2 and 3 show the finished security element 12, but the detailed description of the manufacture of the security element with reference to FIGS. 4 to 7 also is particularly helpful for understanding the complex layer structure and the interaction of the individual layers.

The security element 12 includes a carrier substrate 22 in the form of a transparent plastic foil, for example of a polyethylene terephthalate (PET) foil approximately 20 μm thick. The carrier substrate 22 has opposing first and second main areas, wherein the first main area is supplied with a lens grid 24 of a plurality of substantially cylindrical micro lenses 26.

The thickness of the carrier substrate 22 and the curvature of the focusing lens areas of the micro lenses 26 are matched to one another in such a manner that the focal length of the micro lenses 26 substantially corresponds to the thickness of the carrier substrate 22. The focal plane of the micro lenses 26 then substantially coincides with the second, opposite main area of the carrier substrate 22. As explained above, however, in some embodiments it can also be useful not to let the focal plane coincide with the second main area of the carrier substrate, for example in order to produce particularly thin security elements.

Arranged on the second main area of the carrier substrate 22 there is a laser-sensitive motif layer 30 which, in the embodiment example shown, is composed of two partial layers, namely a color partial layer 32 including chromophore effect pigments and a black contrast partial layer 34. Specifically, the color partial layer 32 in the embodiment example is an Iriodin® ink, that is to say a printing ink with mica-based pearl luster pigments. In the embodiment example, the contrast partial layer 34 is formed by a black printing ink. Without a contrast layer in the background, the color partial layer 32 with the pearl luster pigments appears transparent and practically does not appear when viewed. In the regions in which the contrast partial layer is present and forms a dark background, the pearl luster pigments, on the other hand, appear with strong chromaticity and saturated colors.

The motif layer 30 also includes a multiplicity of parallel, line-shaped transparency regions in the form of line-shaped cutouts 40, which were produced in the manner described in more detail below in precise register with the micro lenses 26 of the lens grid 24. The regions of the motif layer 30 between the cutouts 40 form retained material regions 42, which are also configured to be line-shaped and in precise register with the micro lenses 26. In the embodiment example, the line-shaped cutouts 40 and the line-shaped material regions 42 have the same width, but in general the cutouts and the material regions can also have different widths.

In the retained material regions 42, the motif layer 30 is opaque and structured in the form of a first motif, in the embodiment example in the form of the value number "50". Specifically, the color partial layer 32 represents the number "50" with the colored appearance of the pearl luster pigments against a dark background, while the regions in which only the contrast partial layer 34 is present, form a non-colored, black environment for the value number "50".

Due to the focusing effect of the micro lenses 26, a viewer looks from a first viewing direction 50 respectively at the retained material regions 42 of the motif layer 30 and therefore perceives the colored value number "50" in front of a dark environment as the appearance 14A. The cutouts 40 are not visible from the viewing direction 50, so that the representation of the value number "50" appears over the full area for the viewer.

From a second viewing direction 52, on the other hand, due to the focusing effect of the micro lenses 26, the viewer looks at the cutouts 40 in the motif layer 30, so that the motif layer 30 is not visible from this viewing direction and the perceived appearance depends on the further embodiment of the security element in the cutouts 40. In the embodiment example shown, on the side of the motif layer 30 facing away from the lens grid 24, there is a second motif layer present in the form of a printing layer 60 which is structured in the form of a second motif. As a second motif, a simple motif composed of two differently colored rectangles 62, 64 is shown for illustration purposes, but it will be appreciated that also monochrome or any complex multicolored motifs can also be produced here as desired.

When viewing from the second viewing direction 52, the viewer therefore looks through the cutouts in the first motif layer 30 respectively at the second motif layer 60 and therefore perceives the two, colored rectangles 62, 64 as the appearance 14B.

The security element 12 typically includes further layers 66, such as protective, covering or additional functional layers, which, however, are not essential in the present case and are therefore not described in detail. One or several of the further layers 66 can be opaque and form a background for the representation of the second motif layer 60, or the further layers can be transparent or translucent and allow a view through the security element 12 in some regions if the second motif layer is not full-area.

The second motif layer 60 can be full-area or, as in the embodiment example of FIGS. 2 and 3, it can be present only partially itself and therefore in the regions outside the motif layer 60 allow a view onto an underground layer lying below the security element 12. The underground layer can be formed, for example, by the substrate of the banknote 10 (indicated by dashed lines in FIG. 2) or another data carrier on which the security element 12 is applied. The underground layer can be monochrome or structured itself and, for example, include information that can be recognized in the cutouts 40 from the viewing direction 52. The security element 12 can also be present in a window region of a data carrier, so that the transparent regions lying outside the motif layer 60 represent see-through regions in the security element 12.

The manufacture of the security element 12 will now be explained with reference to FIGS. 4 to 7, wherein the figure part (a) of the figures in each case shows an intermediate step in the manufacture of the security element and the figure part (b) shows the appearance of the respective intermediate product in plan view without the lens grid 24 and thus without the focusing effect of the micro lenses 26.

Figure 4A:
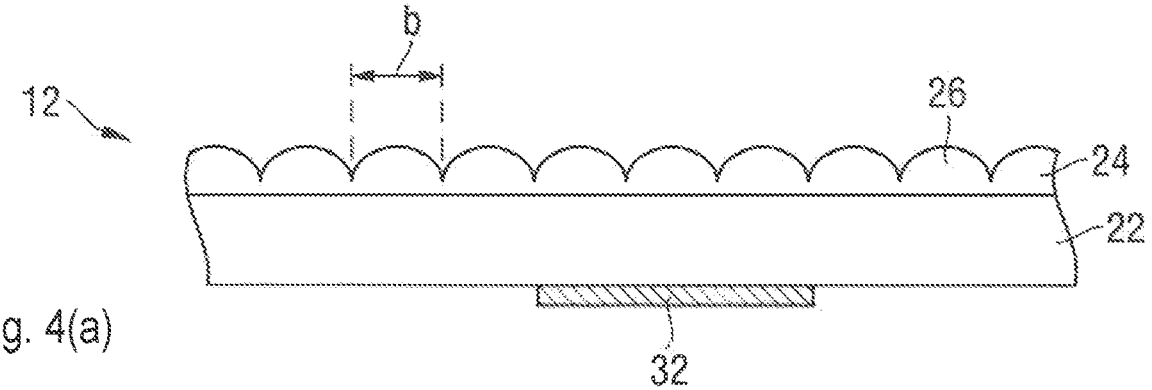
Figure 4B:
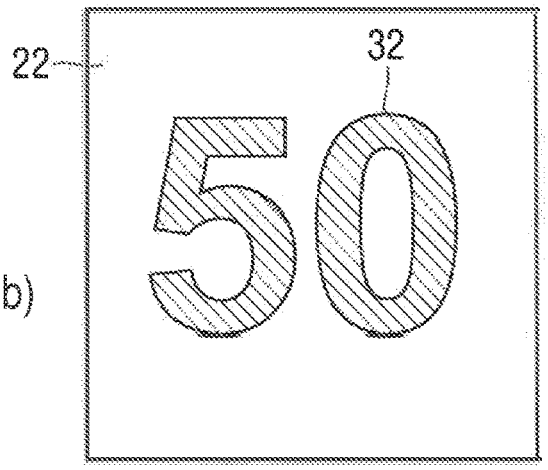

Referring first to FIG. 4, a carrier substrate 22 is made available in the form of a polyethylene terephthalate (PET) foil approximately 20 μm thick and on a first main area is supplied, preferably by embossing, with a lens grid 24 of a plurality of substantially cylindrical micro lenses 26 with a width b=15 μm. Then an Iriodin® printing layer with mica-based pearl luster pigments with a weight per unit area of 1.5 g/m$^2$ is printed in the form of the number "50" in the desired original size on the opposite, second main area of the carrier substrate 22 as color partial layer 32. As shown in the plan view of FIG. 4(*b*), after this method step, the color partial layer 32 structured in the form of the value number "50" is present on the carrier substrate 22.

Figure 5A:
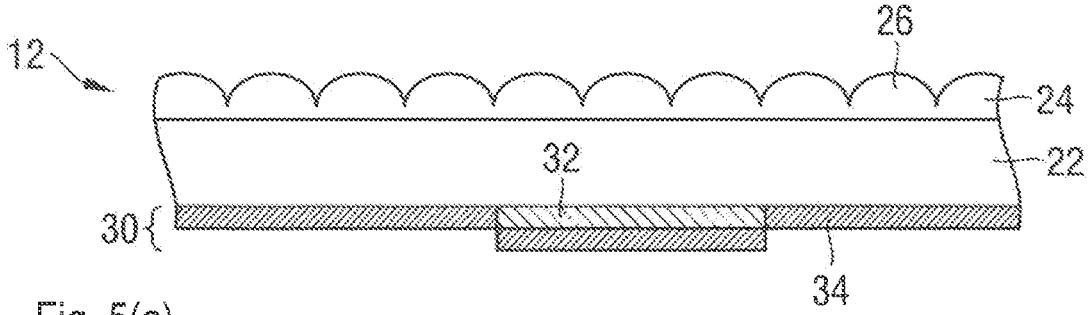
Figure 5B:
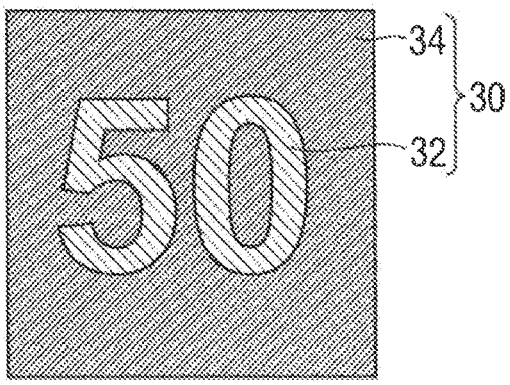

Subsequently, as the second partial layer of the motif layer 30, a black printing layer 34 is printed over the full area of the structured color partial layer 32, as represented in FIG. 5(*a*). It is important here that the black printing layer 34 forms a contrast layer for the pearl luster pigments of the color partial layer 32, and these therefore appear strongly colored against the background of the printing layer 34. As shown in the plan view of FIG. 5(*b*), after this method step the motif layer 30 with the colored value number "50" (reference numeral 32) is present in front of a dark background 34. The printing layer 34 can in particular be printed with a motif-shaped outline, for example as a circular disk, star or the like. The term "full area" means that the printing layer is not configured as a grid but fills the entire area within its outline.

Figure 6A:
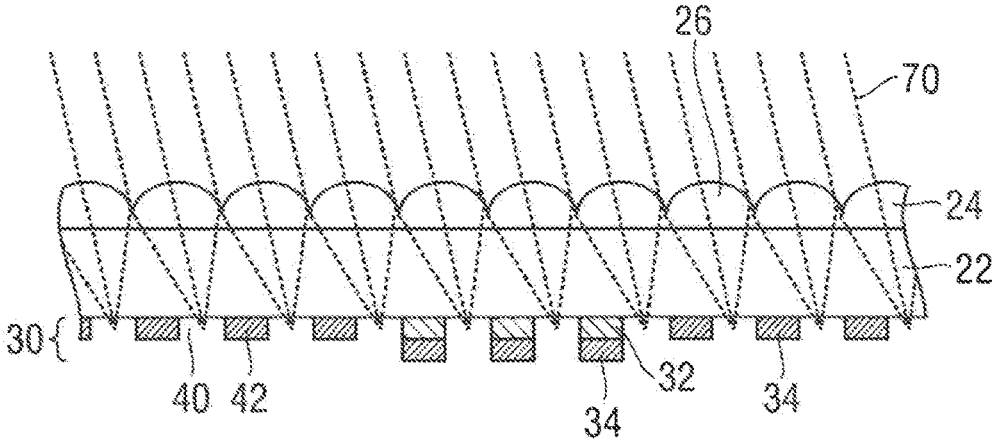
Figure 6B:
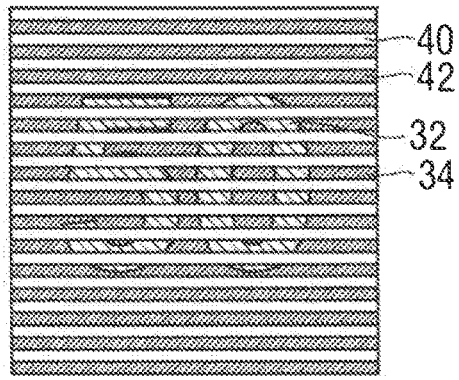

In the next method step, from a predetermined direction, the area of the motif layer 30 is subjected through the lens grid 24 over a large area to near-infrared laser radiation 70, as shown in FIG. 6(*a*). The laser radiation 70 is focused by the cylindrical micro lenses 26 in a line shape onto the motif layer 30 arranged on the second main area of the carrier substrate 22 and there ablates the color partial layer 32 and the black contrast partial layer 34, so that line-shaped cutouts 40 are created in the motif layer 30.

Black printing layers such as the contrast partial layer 34 show a high level of absorption for laser radiation in the near infrared and can be ablated with a wide range of laser parameters without any problems. The color partial layer 32 with the effect pigments is also removed in the embodiment example either by its own absorption or at least by the heat produced during the absorption of the laser radiation by the adjacent black printing layer 34. However, even in variants in which the color partial layer 32 is not physically removed, it no longer appears to be present to the viewer after the laser subjection, since the color partial layer 32 after the ablation of the contrast partial layer 34 behind it practically no longer appears due to its transparency. Configurations that utilize this effect are described in more detail below.

In order to be able to cleanly ablate the partial layers, the ink particles of the color partial layer and the contrast partial layer should be easily transportable. The foil is therefore advantageously not resting on a substrate with the layers to be ablated but is lasered "in suspension". As shown in the plan view of FIG. 6(*b*), after this method step, the motif layer 30 with the colored number "50" (reference numeral 32) and the dark background 34 is still present only in the retained material regions 42. Between the material regions 42, the laser subjection created transparency regions 40 in which the intermediate product is transparent.

Figure 7A:
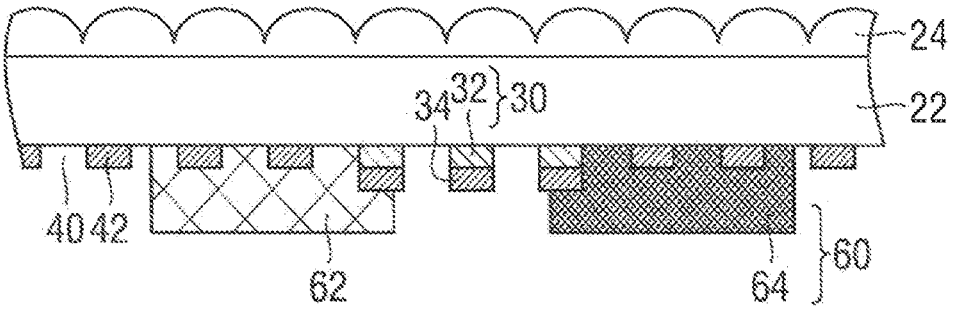
Figure 7B:
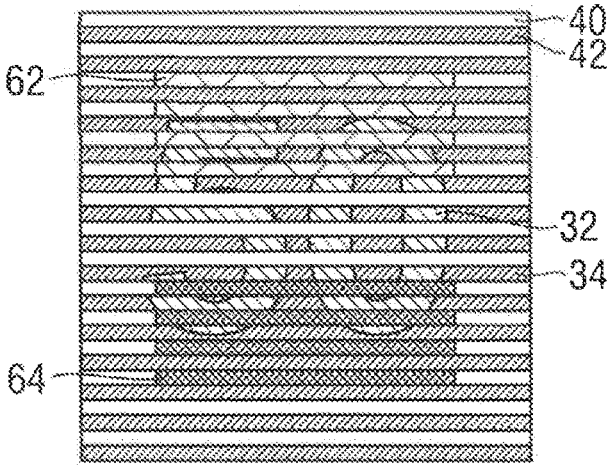

In one variant of the invention, the security element 12 can already be led to the final production after this method step and, for example, be supplied with a transparent protective layer on the second main area, as described in more detail below in connection with FIG. 8. In the invention variant of the present embodiment example (FIG. 7(*a*)), on the other hand, a second motif layer 60 is printed onto the first motif layer 30 supplied with cutouts 40, which is structured in the form of a second motif with two colored rectangles 62, 64. After this method step, the security element now has two structured motif layers 30 and 60, as shown in FIG. 7(*b*), the motifs of which are each visible from the viewing directions 50, 52 (FIG. 2). As far as is visible upon viewing, both motifs are also arranged in precise register with the micro lenses 26 of the lens grid 24, although only a single laser subjection step was required for their production.

Figure 8:
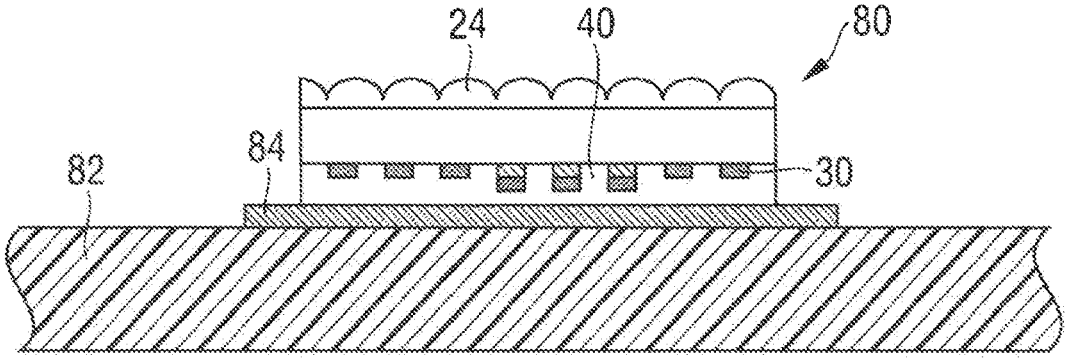

In the variant shown in FIG. 8, the second motif layer 60 was dispensed with and at most transparent layers, for example a transparent protective or covering layer and/or a transparent adhesive layer, were applied to the first motif layer 30. The resulting security element 80, when viewed from a first viewing direction, shows the first motif already described above, formed by the first motif layer 30, and from a second viewing direction reveals a view of an underground layer in the cutouts 40 of the first motif layer 30.

In this manner, it is particularly easy to produce data carriers with tilt images which show a general, generic motif from a first viewing direction and an individualized motif from a second viewing direction. For example, the security element 80 can be intended for use in identification documents 82 and, with its motif layer 30, can show a national coat of arms as the first, generic motif. Since the security element 80 itself only shows the generic motif "national coat of arms", it can be employed unchanged for all identification documents 82 of the same type.

A motif present in a data region 84 of the identification document 82, for example a passport photo of the owner, serves as the individualized motif. This individualized motif is different for each identification document 82. The security element 80 is now adhesively bonded with the data region 84 with the cut-out motif layer 30, 40 so that the national coat of arms of the motif layer 30 is visible from the first viewing direction and the individualized motif of the data region 84 is visible from the second viewing direction.

Figure 9:
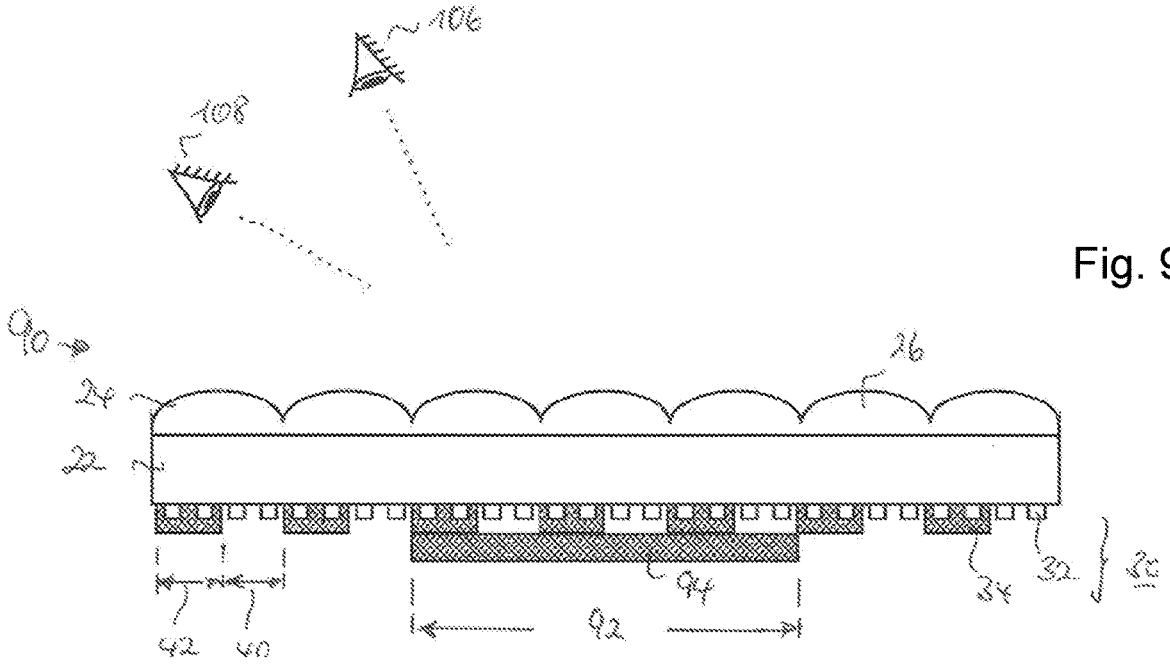
Figure 10A:
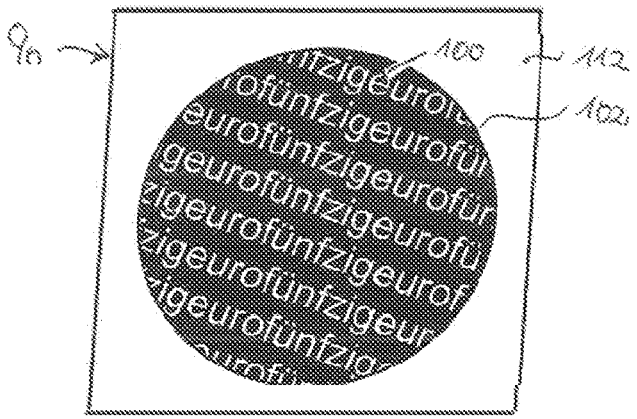
Figure 10B:
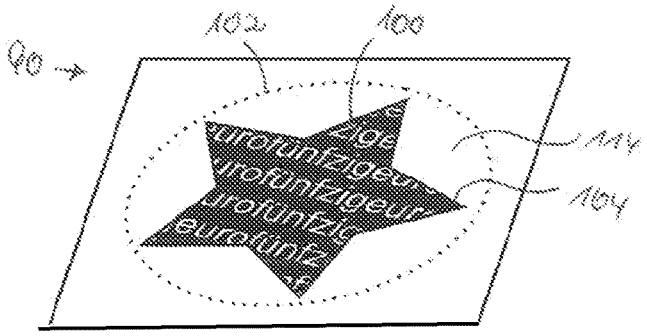

FIGS. 9 and 10 show a further embodiment of a security element 90 according to the invention with a precisely registered tilt effect, for the manufacture of which the clearly different absorption of the color partial layer 32 and the contrast partial layer 34 is utilized in a targeted manner. With reference first to the cross-sectional representation of FIG. 9, the security element 90 is constructed in principle like the security element 12 of FIG. 2 and includes a carrier substrate 22, which is supplied on one main area with a lens grid 24 and on the opposite main area with a first, laser-sensitive motif layer 30. In a motif-shaped partial region 92, a second motif layer 94 is arranged above the first motif layer 30.

The first motif layer 30 is composed of two partial layers, namely a color partial layer 32 including chromophore effect pigments, for example a printing ink with mica-based pearl luster pigments, and a black contrast partial layer 34 which is formed by a black printing ink.

The color partial layer 32 was printed onto the carrier foil 22 as a motif 100 in the form of the continuous writing "fünfzigeuro" ["fiftyeuros"] (FIGS. 10(*a*), 10(*b*)), as described in principle for FIG. 4. Then the contrast partial layer 34 was printed on as a continuous layer in the form of a second motif, in the embodiment example in the form of a circular disk 102 (FIG. 10(*a*)). The cross section in FIG. 9 shows a region of the security element 90 within the printed circular motif 102.

The sequence of layers 32, 34 was then subjected over a large area to NIR laser radiation through the lens grid 24, as described in principle for FIG. 6, wherein the laser parameters are selected such that only the black contrast partial layer 34, but not the color partial layer 32, which is largely transparent to the laser radiation, is ablated by the laser radiation. Due to the significantly higher absorption of the black contrast partial layer 34, such laser parameters can always be found without any problems. If the laser power is not raised too far above the stripping threshold of the contrast partial layer 34, the heat conduction to the color partial layer 32 is also kept sufficiently low to prevent the color partial layer 32 from being stripped off. As a result, after this method step, the motif layer 30 is present on the one hand with non-removed color partial layer 32 and with partially removed contrast partial layer 34. Specifically, the contrast partial layer 34 is ablated in the transparent regions 40 and is retained in the material regions 42, while the color partial layer 32 is preserved in both regions 40, 42.

Then, in a partial region 92 of the circular motif 102, a second motif layer 94 is applied in the form of a also black printing layer in the form of a further motif, in the embodiment example in the form of a star 104 (FIG. 10(*b*)). Further protective, covering or functional layers can follow, but are not essential for the present explanation.

The resulting appearance of the security element 90 from two viewing directions 106, 108 is illustrated in FIGS. 10(*a*) and 10(*b*), respectively.

From a first viewing direction 106, due to the focusing effect of the micro lenses 26 within the circular motif 102, the viewer looks at the respective material regions 42 in which the contrast partial layer 34 was retained. There, the contrast partial layer 34 represents a dark background for the writing 100 "fünfzigeuro" formed by the color partial layer 32, so that the writing appears with saturated colors against the dark background of the circular motif 102, as illustrated in FIG. 10(*a*). In the region 112 outside the circular motif 102, the dark background is missing, so that any color partial layer 32 that may be present there remains practically invisible.

From a second viewing direction 108, on the other hand, due to the focusing effect of the micro lenses 26, the viewer looks at the respective transparency regions 40 of the circular motif 102, in which the contrast partial layer 34 has been removed, but the color partial layer 32 has been retained. In the partial region 92, which is configured in the form of the star motif 104, the second motif layer 94 forms a dark background for the writing 100, so that the colored writing "fünfzigeuro" is still visible there. In the region 114 outside the star motif 104, however, there is no dark background layer present from this viewing direction, so that the color partial layer 32 does not appear there (FIG. 10(*b*)). The area region previously occupied by the circular motif 102 is shown in dashed lines in FIG. 10(*b*).

As a result, when tilting from the first viewing direction 106 into the second viewing direction 108, the security element 90 shows a tilt effect from the circular motif 102 to the star motif 104 with the writing 100 arranged in precise register within the motifs 102, 104, which is always visible in practically the same place.

In some configurations, the color partial layer 32 can be slightly bleached or its color effect changed by the laser subjection when removing the contrast partial layer 34, so that the color impression of the writing 100 in the star motif 104 differs from the color impression of the writing 100 in the circular motif 102. The perfect registration of the writing in both viewing directions is unaffected.

Instead of the black printing layers 34, 94, printing layers with other colors can also be used, wherein darker or stronger color tones, for example a strong red, a dark blue or a deep green, emphasize the effect pigments better. In combination with the color effect of the effect pigments, a colored mother-of-pearl shimmer with a combination of the color of the contrast partial layer 34 or the second motif layer 94 and the color of the effect pigments of the color partial layer 32 is created.

Figure 11:
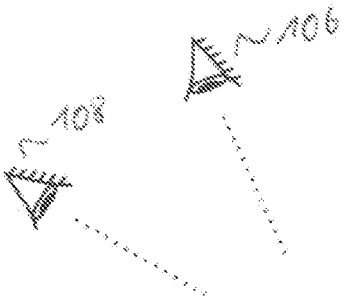
Figure 12A:
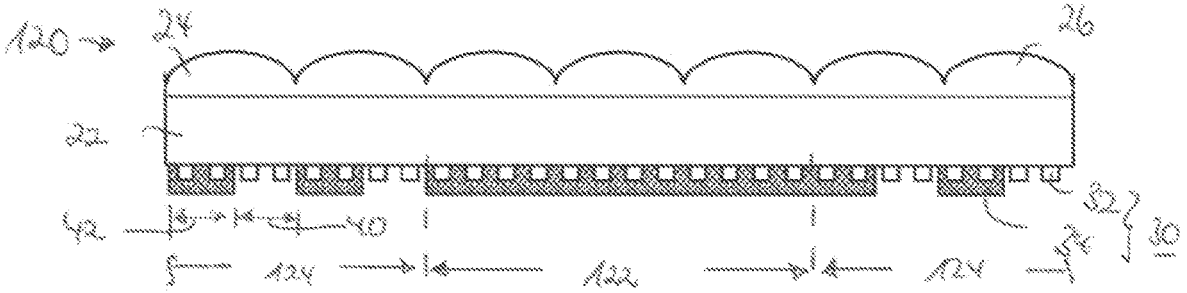
Figure 12A:
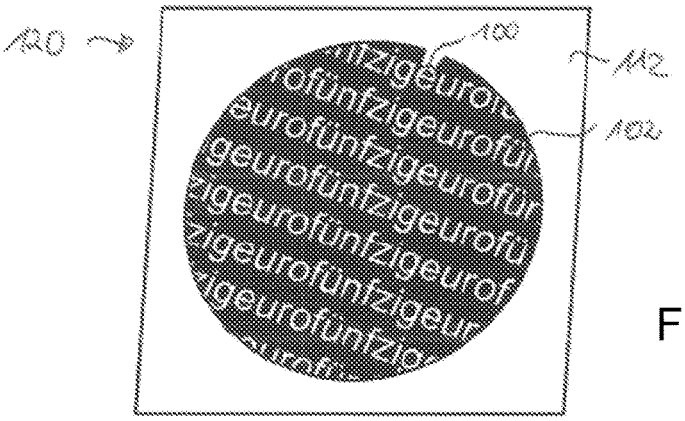
Figure 12B:
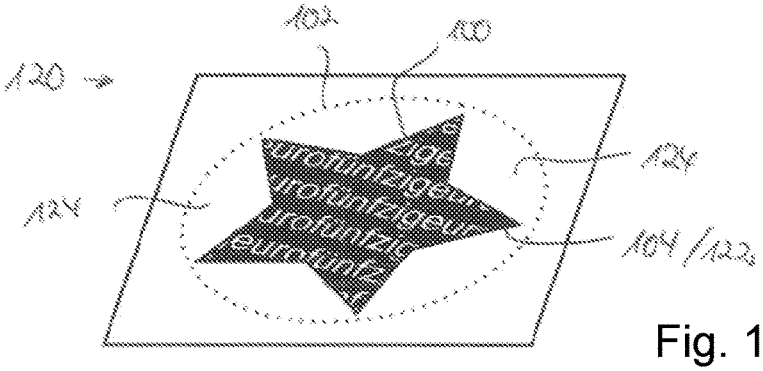

An alternative configuration to the embodiment example of FIGS. 9 and 10 is illustrated in FIGS. 11 and 12 with reference to the security element 120, which shows closely related visual effects, but has a different layer structure and is manufactured in a different manner.

With reference first to the cross-sectional representation in FIG. 11, the security element 120 includes a carrier substrate 22 which is supplied with a lens grid 24 on one main area and with a first, laser-sensitive motif layer 30 on the opposite main area.

The laser-sensitive motif layer 30 is composed of two partial layers, namely a color partial layer 32 in the form of a printing ink with mica-based pearl luster pigments, and a black contrast partial layer 34 which is formed by a black printing ink. As in the configuration of FIG. 9, the color partial layer 32 was printed on as a motif 100 in the form of the continuous writing "fünfzigeuro" (FIGS. 11(*a*), 11(*b*)). Then the contrast partial layer 34 was printed as a continuous layer in the form of a second motif, in the embodiment example in the form of a circle 102 (FIG. 12(*a*)). The cross section in FIG. 11 shows a region of the security element 120 within the printed circular motif 102.

Then the layer sequence 32, 34 was subjected to NIR laser radiation through the lens grid 24, wherein, as in the configuration of the FIGS. 9 and 10, the laser parameters can be selected so that only the black contrast partial layer 34 is ablated, but not the color partial layer 32, which is largely transparent to the laser radiation. In contrast to the configuration of FIGS. 9, 10, however, the motif layer 30 is subjected to laser radiation over a large area over the full area of the circular motif 102. Rather, the motif layer 30 is not subjected to laser irradiation in a partial region 122 of the circular motif 102, which is configured in the form of a star 104. The motif layer is subjected to laser irradiation only in the region 124 which lies outside the partial region 122.

The resulting appearance of the security element 120 from two viewing directions 106, 108 is illustrated in FIGS. 12(*a*) and 12(*b*) and substantially corresponds to the appearance described in connection with FIGS. 9, 10.

From a first viewing direction 106, due to the focusing effect of the micro lenses 26 within the circular motif 102, the viewer looks respectively at those material regions 42 that either lie within the non-subjected region 122 or in the subjected region 124, but in which the contrast partial layer 34 was retained. Within the circular motif 102, the contrast partial layer 34 therefore represents a dark background for the writing "fünfzigeuro" formed by the color partial layer 32, so that the writing 100 appears with saturated colors against the dark background of the circular motif 102, as shown in FIG. 12(*a*). In the region 112 outside the circular motif 102, the dark background is missing, so that any color partial layer 32 that may be present there remains practically invisible.

From a second viewing direction 108, on the other hand, due to the focusing effect of the micro lenses 26 within the circular motif 102 in the region 124, the viewer looks at the transparency regions 40 revealed through lasering, in which the contrast partial layer 34 has been removed. Since there is no dark background layer present in the region 124, the color partial layer 32 cannot be recognized by the viewer. In the non-subjected partial region 122, which is configured in the form of the star motif 104, no transparency regions were produced, so that the contrast partial layer 34 there represents a dark background for the writing 100 and said writing therefore appears in color to the viewer. As a result, the star motif 104 with the colored writing "fünfzigeuro" is visible from the viewing direction 108.

When tilting from the first viewing direction 106 into the second viewing direction 108, there is a tilt effect from the circular motif 102 to the star motif 104 with the writing 100 arranged in each case in precise register within the motifs 102, 104, which is always visible in the same place.

The variant of FIGS. 11, 12, compared to the variant of FIGS. 9, 10, requires a stronger lateral control of the laser radiation, since only the region 124 outside the star motif 104 is subjected to laser radiation. On the other hand, the setting of the laser parameters in this variant is not critical, since during the subjection in the transparent regions 40 not only the contrast partial layer 34 can be removed, but also the color partial layer 32 along with it.

A motif, such as the star motif, can also be produced by a shaped laser beam, as described in more detail in EP 3015279 A1, for example. In particular, the cross section of the laser beam in these variants corresponds to the motif. A plurality of micro lenses of the lens grid is subjected simultaneously to the laser beam with the motif-shaped beam cross section.

The invention claimed is:

1. A security element for securing security papers, value documents and other data carriers, with a lens grid image including a lens grid of a plurality of micro lenses and a radiation-sensitive motif layer arranged at a distance from the lens grid, wherein the radiation-sensitive motif layer in a motif region includes a multiplicity of transparency regions produced by the action of radiation, wherein the radiation-sensitive motif layer has, at least in the motif region, two separate partial layers, a color partial layer and a contrast partial layer, wherein the contrast partial layer of the motif layer is removed in the transparency regions, the color partial layer of the motif layer is preserved in the transparency regions, and the color partial layer comprises chromophore effect pigments that appear to be colored against the background of the contrast partial layer and which appear to be transparent without a contrast layer.

2. The security element according to claim 1, wherein the contrast partial layer is formed by a chromatic or dark printing layer.

3. The security element according to claim 1, wherein the color partial layer includes interference pigments, pearl luster pigments and/or liquid crystal pigments as chromophore effect pigments.

4. The security element according to claim 1, wherein the contrast partial layer and/or the color partial layer is configured in the form of patterns, characters or a code.

5. The security element according to claim 1, wherein the lens grid image shows at least two different appearances from different viewing directions, wherein the transparency regions each are arranged in precise register with the micro lenses of the lens grid, and the radiation-sensitive motif layer outside the transparency regions produced by the action of radiation is opaque and is structured in the motif region in the form of a first motif, so that the first motif is visible as the first appearance when viewing the security element from a first viewing direction through the lens grid.

6. The security element according to claim 1, wherein the radiation-sensitive motif layer is laser-sensitive.

7. The security element according to claim 1, wherein the lens grid has or represents a one-dimensional arrangement of micro lenses or that the lens grid has or represents a two-dimensional arrangement of micro lenses.

8. The security element according to claim 1, wherein a second motif layer is arranged on the side of the radiation-sensitive motif layer facing away from the lens grid, which is structured in the form of a second motif, wherein the second motif is visible as a second appearance when viewing the security element from a second viewing direction through the lens grid and the transparency regions of the radiation-sensitive motif layer.

9. The security element according to claim 8, wherein the second motif layer is formed by a chromatic or dark printing layer.

10. The security element according to claim 8, wherein the second motif layer, apart from the transparency regions produced by the action of radiation, lies completely within the area of the contrast partial layer.

11. The security element according to claim 1, wherein one or several transparent layers are arranged on the side of the radiation-sensitive motif layer facing away from the lens grid, so that an underground lying below the security element is visible as a second appearance when viewing the security element from a second viewing direction through the lens grid and the transparency regions of the radiation-sensitive motif layer.

12. The data carrier with a security element configured according to claim 11, wherein the data carrier is supplied in a partial region with a second motif layer which is structured in the form of a second motif, and that the security element is arranged with the lens grid and the transparency regions above the second motif layer so that the second motif is visible as a second appearance when viewing the security element from a second viewing direction through the lens grid and the transparency regions of the radiation-sensitive motif layer.

13. A data carrier with a security element according to claim 1.

14. A method for manufacturing a security element with a lens grid image, in which a carrier substrate is made available and supplied with a lens grid composed of a plurality of micro lenses and a radiation-sensitive motif layer arranged at a distance from the lens grid, and in the radiation-sensitive motif layer a multiplicity of transparency regions is produced by the action of radiation through the lens grid, wherein the radiation-sensitive motif layer is formed, at least in the motif region, with two separate partial layers, a color partial layer and a contrast partial layer, wherein the contrast partial layer of the motif layer is removed in the transparency regions, the color partial layer of the motif layer is preserved in the transparency regions, and the color partial layer comprises chromophore effect pigments which appear to be colored against the background of the contrast partial layer and which appear to be transparent without a contrast layer.

15. The method according to claim 14, wherein the lens grid image shows at least two different appearances from different viewing directions, and that in the method the transparency regions in the radiation-sensitive motif layer are produced in precise register with the micro lenses of the lens grid, and the radiation-sensitive motif layer outside of the transparency regions produced by the action of radiation is configured to be opaque and structured in the form of a first motif, so that the first motif is visible as the first appearance when viewing the security element from a first viewing direction through the lens grid.

16. The method according to claim 14, wherein the radiation-sensitive motif layer is subjected to laser radiation through the lens grid in order to produce the transparency regions.

17. A security element for securing security papers, value documents and other data carriers, with a lens grid image including a lens grid of a plurality of micro lenses and a radiation-sensitive motif layer arranged at a distance from the lens grid, wherein the radiation-sensitive motif layer in a motif region includes a multiplicity of transparency regions produced by the action of radiation and a multiplicity of contrast regions, wherein the radiation-sensitive motif layer has, at least in the motif region, two separate layers, a color partial layer and a contrast partial layer, the color partial layer comprising chromophore effect pigments that appear to be colored against the background of the contrast partial layer and which appear to be transparent without a contrast layer, the color partial layer appearing to be colored against the background of the contrast partial layer in the contrast regions, wherein the contrast partial layer of the motif layer is removed in the transparency regions, such that the transparency regions appear to be transparent, and the color partial layer of the motif layer is preserved in the transparency regions.

* * * * *